United States Patent [19]

Llort

[11] Patent Number: 4,792,141

[45] Date of Patent: Dec. 20, 1988

[54] GOLF BALL COVER COMPOSITION

[75] Inventor: Francisco M. Llort, Dighton, Mass.

[73] Assignee: Acushnet Company, New Bedford, Mass.

[21] Appl. No.: 40,292

[22] Filed: Apr. 20, 1987

[51] Int. Cl.[4] ..... A63B 37/12; C08L 7/00; C08L 9/00; C08L 19/00

[52] U.S. Cl. ..... 273/235 R; 524/908; 524/525; 524/526; 525/125; 525/201; 525/216; 525/232; 525/236

[58] Field of Search ..... 273/235 R; 524/908; 525/232, 201, 236, 195, 263, 125, 216

[56] References Cited

U.S. PATENT DOCUMENTS

| | | | |
|---|---|---|---|
| 2,143,544 | 1/1939 | Crawford | 273/235 |
| 3,362,937 | 1/1968 | Kent | 273/235 |
| 4,323,247 | 4/1982 | Keches et al. | 273/235 R |
| 4,341,667 | 7/1982 | Lai et al. | 521/41 |

*Primary Examiner*—Allan M. Lieberman
*Attorney, Agent, or Firm*—Lucas & Just

[57] ABSTRACT

An improved golf ball cover is disclosed. The cover has balata replaced by polyoctenylene rubber in an amount up to 40 parts without producing a deleterious effect on the cover yet maintaining the good "click" and "feel" of a balata covered golf ball and increasing the toughness of the ball cover.

15 Claims, No Drawings

GOLF BALL COVER COMPOSITION

This invention relates to golf balls and, more particularly, to balata covered golf balls where up to 40% of the balata used to form the cover has been replaced with polyoctenylene rubber.

Typically, golf balls are made by forming a cover about a core. Cores are either wound or solid and measure about 1.4 to 1.6 inches in diameter, generally. The cover is formed about the core to produce a golf ball having a diameter of about 1.68 inches and weighing about 1.62 ounces. Both the weight and diameter are set by the United States Golf Association (USGA). British golf balls, generally, have a smaller core, about 1.35 to 1.55 inches in diameter and a finished size of about 1.62 inches in diameter.

Generally, solid cores are made by mixing components such as polybutadiene with zinc diacrylate or zinc dimethacrylate and adding to this mixture a free radical initiator to cause cross-linking between the polybutadiene and the diacrylate/dimethacrylate. From this mixture solid, hard cores are molded.

Wound cores are typically made by winding a very long elastic thread about a center. The center is either a solid or a liquid filled balloon. The core measures typically about 1.0 to 1.3 inches in diameter and the thread is wound around the center to produce the finished core having a diameter of about 1.4 to 1.6 inches.

Golf ball covers were made solely from balata, a common name for trans polyisoprene, until the 1960's when E. I. duPont de Nemours and Co. introduced SURLYN®, an ionic copolymer of methacrylic acid and ethylene. SURLYN has, for the most part, replaced balata because SURLYN covered balls have superior cut resistance, and because SURLYN is cheaper and more available than balata.

Cut resistance is the ability of the cover to withstand the repeated punishment provided to the cover every time the ball is hit with a club.

Balata is more expensive than SURLYN because it is a specialty polymer which is produced in limited volume.

There are a number of golfers who prefer balata over SURLYN because of the better control afforded to them by the balata and because of the "click" and "feel" of the balata as compared to the SURLYN.

"Click" refers to the sound made when the club impacts upon the ball and "feel" is the overall sensation imparted to the golfer when the ball is hit. Although "click" and "feel" are not quantifiable, they are very real characteristics of any golf ball and some professional golfers prefer balata covered balls for these very reasons. Needless to say, balata is still used today as a cover material.

Another standard set for golf balls by the USGA besides size and weight is the initial velocity. Initial velocity has been set at a maximum of 255 feet per second (250 feet per second with a 2% tolerance) when measured on apparatus approved by the USGA. Golf ball manufacturers strive to come as close to this maximum as possible without exceeding it and any improvement which gets a ball closer to the "magic" 255 is looked at favorably.

It has now been discovered that polyoctenylene rubber can be blended with balata to decrease the overall amount of balata used to form a cover without resulting in a deleterious effect on the golf ball cover. In fact, the use of polyoctenylene rubber with balata has been found to produce a number of advantages besides decreasing the amount of balata used. One of the main advantages is an increase of cut resistance. Another advantage is that even though the amount of balata in the cover is decreased the "click" and "feel" has been found to be equivalent to a balata covered ball. Additionally, comparable if not slight increases in initial velocity have been noted in golf balls made in accordance with the present invention.

Preferably, trans polyoctenylene rubber is used in forming golf ball covers in accordance with the present invention and more preferred polyoctenylene rubber having a high trans content is used. Polyoctenylene rubber having a high trans content is commercially available under the trade name VESTENAMER from Huls Corp. of West Germany. Such polymer is formed from cyclooctadiene which has been polymerized to have a high percentage of trans double bonds. The percent of trans polyoctenylene rubber in polyoctenylene rubber having a high trans content is preferably at least about 50% by weight.

It has been found that polyoctenylene rubber may be incorporated into a cover of a golf ball to reduce the amount of balata used and that the addition of polyoctenylene rubber has no apparent adverse effect on the other components used in forming a typical balata covered golf ball.

Generally, it has been found that a golf ball can be made in accordance with the present invention from a core and a cover wherein the cover is formed from a composition comprising balata and about 3 to about 40 parts by weight polyoctenylene rubber based on 100 parts by weight polymer in the composition. It has been found that polyoctenylene rubber can be used as a 1:1 replacement for balata, thereby decreasing the overall amount of balata used in the composition. More preferred is to make a golf ball from a core and a cover wherein the cover is formed from a composition comprising balata and about 3 to about 15 parts by weight polyoctenylene rubber based on 100 parts by weight polymer in the composition. Most preferred is a golf ball made from a core and a cover wherein the cover is formed from a composition comprising balata and about 6 to about 12 parts by weight polyoctenylene rubber based on 100 parts by weight polymer in the composition.

More specifically, it has been found that a golf ball can be made in accordance with the present invention from a core and a cover wherein the cover is formed from a composition comprising about 97 to about 60 parts by weight balata based on 100 parts by weight polymer in the composition and about 3 to about 40 parts by weight polyoctenylene rubber based on 100 parts by weight polymer in the composition. More preferred is a golf ball made from a core and a cover wherein the cover is formed from a composition comprising about 97 to about 85 parts by weight balata based on 100 parts by weight polymer in the composition and about 3 to about 15 parts by weight polyoctenylene rubber based on 100 parts by weight polymer in the composition. Most preferred is a golf ball comprising a core and a cover wherein the cover is formed from a composition comprising about 94 to about 88 parts by weight balata based on 100 parts by weight polymer in the composition and about 6 to about 12 parts by weight polyoctenylene rubber based on 100 parts by weight polymer in the composition.

A preferred embodiment of the present invention is a golf ball comprising a core and a cover wherein the cover is formed from a composition comprising about 97 to about 60 parts balata based on 100 parts by weight polymer in the composition, about 3 to about 40 parts by weight polyoctenylene rubber based on 100 parts by weight polymer in the composition; up to about 30 parts by weight inorganic filler based on 100 parts by weight polymer in the composition; and up to about 2 parts by weight sulfur based on 100 parts by weight polymer in the composition. Additional materials which may be included in the golf ball cover include other polymers besides balata and polyoctenylene rubber, dyes, U.V. light absorbers, as well as other known additives. Typically, an accelerator is added to the composition to aid in curing.

The sulfur is used as a vulcanizing agent and the inorganic filler is used to add weight to the golf ball. Typical inorganic fillers are titanium dioxide and zinc oxide. Polymers, in addition to balata and polyoctenylene rubber that can be included in the composition, include polybutadiene, polyurethane, SURLYN®, polystyrene and natural rubber. Of these, polystyrene and natural rubber are preferred. When these other polymers are added to the composition, the amount added should not be so much as to adversely affect the flow properties of the composition.

When polystyrene is used in the composition of the present invention, it is preferably present in an amount from about 0 to about 40 parts by weight based on 100 parts by weight polymer in the composition. More preferred is when the polystyrene is present in the composition of the present invention, it is present in an amount of about 0 to about 23 parts by weight based on 100 parts by weight polymer in the cover composition. Most preferred is the situation where, when polystyrene is present in the composition, it is present in an amount of about 15 to about 23 parts by weight based on 100 parts by weight polymer in the cover composition.

It has been found that at higher ranges of polystyrene, say about 40 parts by weight based on 100 parts by weight polymers in the composition, the amount of polyoctenylene rubber used in the composition should be in the range of about 10 parts by weight based on 100 parts by weight polymer in the composition. When the amount of polystyrene is reduced, then the amount of polyoctenylene rubber can be increased up to the full 40 parts by weight based on 100 parts by weight polymer in the composition.

When natural rubber is used in the composition of the present invention, it is preferably present in an amount from about 0 to about 10 parts by weight based on 100 parts by weight polymer in the composition. More preferred is when the composition of the present invention contains natural rubber, that it be present in an amount from about 0 to about 5 parts by weight based on 100 parts by weight polymer in the composition. Most preferred is when the composition has natural rubber, that the natural rubber be present in an amount from about 1 to about 3 parts by weight based on 100 parts by weight polymer in the composition.

Using more than about 40 parts by weight of polyoctenylene based on 100 parts by weight polymer in the composition has been found to produce deleterious effects. Lower amounts, say about 1 or 2 parts by weight based on 100 parts by weight polymer in the composition, can be used without having any noticeable effect on the cover.

Good results have been obtained in accordance with the present invention with a golf ball comprising a core and a cover wherein the cover is formed from a composition comprising about 60 to about 70 parts by weight balata based on 100 parts by weight polymer in the composition; about 5 to about 15 parts by weight polyoctenylene rubber based on 100 parts by weight polymer in the composition; about 5 to about 15 parts by weight natural rubber based on 100 parts by weight polymer in the composition; about 15 to about 25 parts by weight polystyrene based on 100 parts by weight polymer in the composition; up to about 30 parts by weight inorganic filler based on 100 parts by weight polymer in the composition; and up to about 2 parts by weight sulfur based on 100 parts by weight polymer in the composition.

The term parts as used in the specification and claims herein means parts by weight based on 100 parts by weight polymer in the composition used to form the cover. The phrase polymer in the composition refers to all polymers, e.g. balata, polyoctenylene rubber, natural rubber, polystyrene, polybutadiene, polyurethane and SURLYN®, that are added to the composition used to form the cover.

In order to make a golf ball with a cover formed from a composition made in accordance with this invention, conventional mixing and molding procedures for making a balata covered golf ball are used. Generally, the components of the composition are mixed together in a mill such as a two roll mill. The blended composition is then formed into slabs. The blended composition is maintained in a slab state until such time as golf balls are ready to be molded. When the balls are ready to be molded, strips are cut from the slab and cups or half shells of the blended composition are formed about the cores. The core may be either solid or wound. Wound cores are preferred in this invention. Such molding procedures for forming the blended composition around a golf bal core are well known to those of skill in the art and vary slightly from manufacturer to manufacturer.

These and other aspects of the present invention may be more fully understood with respect to the following examples.

EXAMPLE 1

This example illustrates making eight dozen golf balls with the composition of the present invention. One dozen conventional balata covered balls were made for purposes of comparison. Each set of twelve balls were made by molding the compositions as listed in Table I below about wound cores.

TABLE I

| Ball No. | Balata (Parts) | Polyoctenylene Rubber (Parts) | Total (Parts) |
|---|---|---|---|
| Control | 100 | — | 100 |
| 1 | 97 | 3 | 100 |
| 2 | 95 | 5 | 100 |
| 3 | 94 | 6 | 100 |
| 4 | 88 | 12 | 100 |
| 5 | 85 | 15 | 100 |
| 6 | 76 | 24 | 100 |
| 7 | 75 | 25 | 100 |
| 8 | 60 | 40 | 100 |

Based on the 100 parts by weight of balata and polyoctenylene rubber combined, the following chemicals were also added to each composition.

TABLE 1 cont.

| Ingredients | Parts |
|---|---|
| $TiO_2$ | 16.76 |
| ZnO | 11.74 |
| Sulfur | 1.3 |
| Stearic Acid | 0.23 |
| Thiazole accelerator | 0.091 |

In order to make the composition for the above balls, a master blend was first prepared containing 100 parts by weight balata, 100 parts by weight $TiO_2$, 70 parts by weight ZnO, 1.5 parts by weight stearic acid and 0.5 parts by weight thiazole accelerator. The $TiO_2$ and ZnO are both inorganic fillers. In each case, 45.6 parts by weight of this master blend was added to a mix of the remaining balata, polyoctenylene rubber and sulfur to arrive at the final compositions listed in Table I above. The polyoctenylene rubber used in this example had a high trans content and was obtained from Huls Corporation of West Germany under the tradename VESTENAMER.

The wound cores had a frozen liquid center upon which elastic thread had been wound to produce a finished core size of about 1.61 inches. Around these cores the compositions of Table I above were molded in a conventional manner to form a cover and produce finished dimpled golf balls of about 1.68 inches in diameter. These balls had 384 dimples distributed uniformly about the cover.

EXAMPLE 2

All of the golf balls of Example 1 were tested following standard USGA initial velocity test procedures. The values obtained from such testing are reported in Table II below.

TABLE II

| Ball No. | Balata (Parts) | Polyoctenylene Rubber (Parts) | Initial Velocity (Ft/Sec) |
|---|---|---|---|
| Control | 100 | 0 | 251.85 |
| 1 | 97 | 3 | 252.20 |
| 2 | 95 | 5 | 251.54 |
| 3 | 94 | 6 | 252.25 |
| 4 | 88 | 12 | 252.45 |
| 5 | 85 | 15 | 251.95 |
| 6 | 76 | 24 | 252.10 |
| 7 | 75 | 25 | 252.05 |
| 8 | 60 | 40 | 252.15 |

It can be seen that the initial velocities obtained for the golf balls made in accordance with the present invention are comparable and in several instances better than that of the conventional golf ball.

It is truly surprising and unexpected that by deleting as much as 40% of the balata from the cover and substituting polyoctenylene rubber therefor that the resulting golf ball will still have comparable or better initial velocity results.

EXAMPLE 3

This example illustrates the improved cut resistance obtained using the present invention. Table III below shows comparative test data measured on selected golf balls from Example 1 above.

TABLE III

| Ball No. | Guillotine Cut (in.) | Shore C |
|---|---|---|
| Control | 28.3 | 85 |
| 1 | 30.0 | 81 |
| 3 | 30.6 | 80 |
| 4 | 30.3 | 80 |
| 6 | 27.0 | 81 |

In the guillotine test a knife edge weighing five pounds was impacted against the golf ball from a specific height under the force of gravity. The values given for cut resistance were determined by the height at which the knife edge cut completely through the cover of the golf ball. It can be seen that the present invention provides comparable if not better results than the standard balata cover in terms of the guillotine test.

The Shore C numbers were obtained by using a durometer manufactured by Shore Instruments Corporation. The model used in this specific example was the Shore C. The procedure employed to carry out the tests with the Shore C durometer are those procedures used on a Shore A and D durometer except that a Shore C durometer was used instead of a Shore A or D durometer. The procedure for the Shore A and D durometer is outlined in ASTM D-2240-68.

It is truly surprising and unexpected that improved toughness is imparted to the golf ball where up to 40% of the balata has been replaced with polyoctenylene rubber.

EXAMPLE 4

In order to determine the "click" and "feel" of a golf ball made in accordance with the present invention, golf balls were made with wound cores as in Example 1 above with covers formed from compositions as listed in Table IV below.

TABLE IV

| Material | Present Invention (Parts) | Control (Parts) |
|---|---|---|
| Cover Polymers | | |
| Balata | 74.0 | 100 |
| Polyoctenylene Rubber | 7.9 | |
| Polystyrene | 16.1 | |
| Natural Rubber | 2.0 | |
| Other Additives | | |
| $TiO_2$ | 16.7 | 16.7 |
| ZnO | 11.7 | 11.7 |
| Stearic Acid | 0.27 | 0.27 |
| Thiazole Initiator | 0.09 | 0.09 |
| Sulfur | 1.3 | 1.3 |

Fourteen professional golfers played 18 holes of golf. Each player played both control and the present invention ball. Interviews of the golfers after playing the 18 holes confirmed that the "click" and "feel" of the present invention ball was comparable to conventional balata balls.

Such results are indeed surprising and unexpected. This means that a ball having less balata in the cover stock can be made which will satisfy the golfer's want for a ball with the "click" and "feel" of a conventional balata ball while providing improved cut resistance as shown in Example 2 above.

It will be understood that the claims are intended to cover all changes and modifications of the preferred embodiments of the invention herein chosen for the purpose of illustration which do not constitute departure from the spirit and scope of the invention.

What is claimed is:

1. A golf ball comprising a core and a cover wherein the cover is formed from a composition comprising about 97 to about 60 parts balata and about 3 to about 40 parts by weight polyoctenylene rubber based on 100 parts by weight polymer in the composition, the polyoctenylene having a trans polyoctenylene content of at least about 50%.

2. The golf ball of claim 1 wherein the polyoctenylene rubber is present in an amount from about 3 to about 15 parts by weight based on 100 parts by weight polymer in the composition.

3. The golf ball of claim 1 wherein the polyoctenylene rubber is present in an amount from 6 to about 12 parts by weight based on 100 parts by weight polymer in the composition.

4. The golf ball of claim 2 wherein the balata is present in an amount from about 97 to about 85 parts by weight based on 100 parts by weight polymer in the cover.

5. The golf ball of claim 3 wherein the balata is present in an amount from about 94 to about 88 parts by weight based on 100 parts by weight polymer in the composition.

6. The golf ball of claim 1 wherein the polyoctenylene rubber is trans polyoctenylene rubber.

7. The golf ball of claim 1 wherein the composition further comprises about 0 to about 40 parts by weight polystyrene based on 100 parts by weight polymer in the composition.

8. The golf ball of claim 1 wherein the composition further comprises about 0 to about 10 parts by weight natural rubber based on 100 parts by weight polymer in the composition.

9. The golf ball of claim 7 wherein the composition further comprises about 0 to about 10 parts by weight natural rubber based on 100 parts by weight polymer in the composition.

10. The golf ball of claim 9 wherein the polyoctenylene rubber is trans polyoctenylene rubber.

11. A golf ball comprising a core and a cover, wherein the cover is formed from a composition comprising about 97 to about 60 parts balata based on 100 parts by weight polymer in the composition; about 3 to about 40 parts by weight polyoctenylene rubber based on 100 parts by weight polymer in the composition, the polyoctenylene having a trans polyoctenylene content of at least about 50%; up to about 30 parts by weight inorganic filler based on 100 parts by weight polymer in the composition; and up to about 2 parts by weight sulfur based on 100 parts by weight polymer in the composition.

12. The golf ball of claim 11 wherein the cover is further comprised of one or more additives selected from the group consisting of dyes, U.V. light absorbers and one or more polymers other than balata or polyoctenylene.

13. The golf ball of claim 11 wherein the polyoctenylene rubber is trans polyoctenylene rubber.

14. A golf ball comprising a core and a cover wherein the cover is formed from a composition comprising about 60 to about 70 parts by weight balata based on 100 parts by weight polymer in the composition; about 5 to about 15 parts by weight polyoctenylene rubber based on 100 parts by weight polymer in the composition, the polyoctenylene having a trans polyoctenylene content of at least about 50%; about 5 to about 15 parts by weight natural rubber based on 100 parts by weight polymer in the composition; about 15 to about 25 parts by weight polystyrene based on 100 parts by weight polymer in the composition; up to about 30 parts by weight inorganic filler based on 100 parts by weight polymer in the composition; and up to about 2 parts by weight sulfur based on 100 parts by weight polymer in the composition.

15. The golf ball of claim 14 wherein the polyoctenylene rubber is trans polyoctenylene rubber.

* * * * *